US005816157A

United States Patent [19]

Gertsch et al.

[11] Patent Number: 5,816,157

[45] Date of Patent: Oct. 6, 1998

[54] ROTARY PRINTING PRESS WITH RETRACTABLE RUBBER CYLINDERS

[75] Inventors: Peter Gertsch, Neiderscherli; Robert Imhof, Bern, both of Switzerland

[73] Assignee: Maschinenfabrik WIFAG, Bern, Switzerland

[21] Appl. No.: 642,627

[22] Filed: May 3, 1996

[30] Foreign Application Priority Data

May 5, 1995 [CH] Switzerland ..... 195 16 653.1

[51] Int. Cl.[6] ..... B41F 13/24

[52] U.S. Cl. ..... 101/247; 101/182

[58] Field of Search ..... 101/247, 220, 101/225, 189, 218, 182, 184, 185, 139, 140, 144, 143, 145, 177

[56] References Cited

U.S. PATENT DOCUMENTS

Re. 34,483 12/1993 Bowman et al. ..... 101/247
4,281,595 8/1981 Fujishiro ..... 101/182
5,337,664 8/1994 Hannon ..... 101/247
5,383,393 1/1995 Ueda et al. ..... 101/220
5,445,076 8/1995 Sugiyama et al. ..... 101/247

FOREIGN PATENT DOCUMENTS 0023039 1/1981 European Pat. Off. ..... 101/220

*Primary Examiner*—Eugene H. Eickholt
*Attorney, Agent, or Firm*—McGlew and Tuttle

[57] ABSTRACT

A rotary printing press with rubber-rubber printing units arranged essentially vertically above one another. The rubber cylinders of at least one rubber-rubber printing unit can be retracted from one another in the formation of a usable gap between the two rubber cylinders.

18 Claims, 5 Drawing Sheets

ROTARY PRINTING PRESS WITH RETRACTABLE RUBBER CYLINDERS

FIELD OF THE INVENTION

The present invention pertains to a rotary printing press with rubber-rubber printing units arranged essentially vertically above one another.

BACKGROUND OF THE INVENTION

Because of the often limited headroom in newspaper plants, rotary printing presses have been developed in a compact design. In such plants, e.g., eight single-color printing units are arranged such that two consecutive printing units form a so-called H-shaped printing unit. An example of the compact design is shown in the Special Report 6.16 of the ifra, July 1994, pages 15 and 18. This is the so-called eight-tower design with H-shaped printing units.

The overall height of the printing tower, which is kept low by means of this H design, has a negative effect on the accessibility to the components of the printing tower, especially the cylinders and the rollers. Only a low-lying maintenance tunnel, which can be used by the operating personnel only in a bent-down position, remains open between the H-shaped printing units arranged above one another. The same applies especially for the accessibility to the lowermost and uppermost printing units of such a printing tower.

SUMMARY AND OBJECTS OF THE INVENTION

The object of the present invention is to provide a rotary printing press with printing stations or printing units arranged essentially vertically above one another, which is built flat and whose printing units, forming cylinders and rollers, are easily accessible, e.g., for adjustments and maintenance work.

According to the invention, a rotary printing press is provided with rubber-rubber printing units, arranged essentially vertically above one another. A rubber cylinder support retracting means is provided whereby the rubber cylinders of at least one printing unit can be retracted from one another in the formation of a usable gap between the said two rubber cylinders.

Preferably at least every other one of the said rubber-rubber printing units has said rubber cylinders, which can be retracted from one another. The rubber-rubber printing units of the printing tower preferably form either all "Δ"-shaped or "V"-shaped cylinder bridges. The web deflecting roller are preferably arranged between two retractable rubber cylinders before the feeding in of the web and one web deflecting roller after the delivery of the web from these rubber cylinders are arranged close to one side of a gap, which is formed after the retraction. According to the present invention, in a generic rotary printing press, a pressure cylinder and its counterpressure cylinder can be retracted from each other such that a usable gap, which can be easily used by an operator, e.g., for the purpose of replacing a roller, is formed between the cylinders of such a printing unit, namely the two rubber cylinders.

According to one preferred embodiment of the present invention, at least every other one of the rubber-rubber printing units, which are arranged above one another, has rubber cylinders, which can be retracted from each other. Easy accessibility is made possible by the gap, which is formed thereby after retracting the two rubber cylinders. An especially easy access to all printing units of a printing tower is provided by the retractability of the rubber cylinders of all printing units of a printing tower.

The rubber-rubber printing units of a printing tower are preferably arranged either as "Δ"-shaped or "V"-shaped cylinder bridges. The printing tower is hereby built especially low. Another advantage is based on the fact that the ink and the wetting agent for each printing unit are fed in the same direction, either against or with the force of gravity, to the rubber cylinder in question. This improves the uniformity of the color structure of the printing units with one another.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
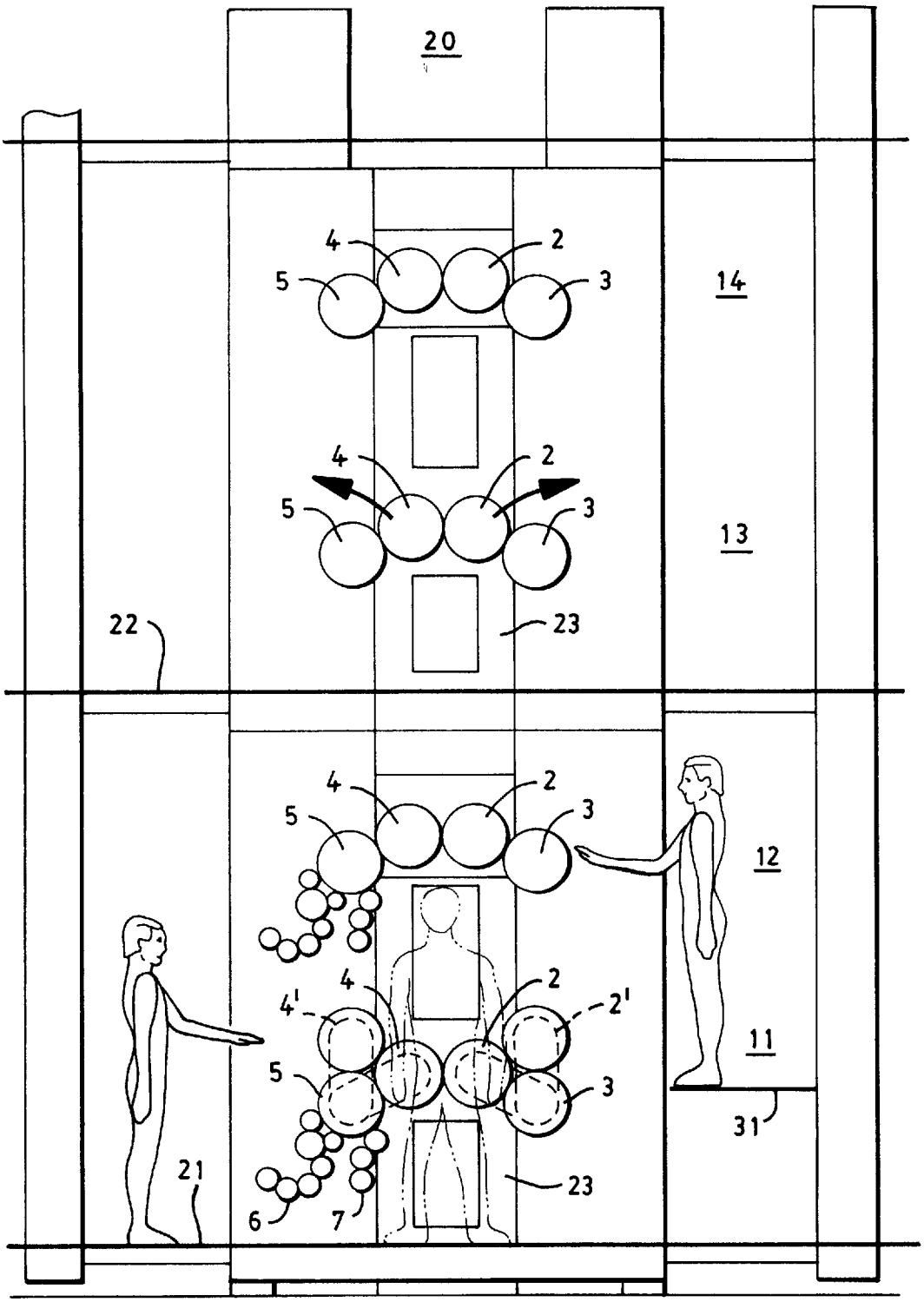
FIG. 1 is a schematic view of a printing tower according to the present invention.

FIG. 1 shows a printing tower 20 of a rotary printing press, which has four printing units 11, 12, 13 and 14 of the same kind arranged above one another. Each of these printing units 11–14 comprises a pair of pressure and counterpressure cylinders, namely rubber blanket cylinders 2 and 4, their plate cylinders 3 and 5 associated with each, as well as ink and wetting units 6 and 7 arranged downstream of the plate cylinders 3 and 5, of which, however, only two are shown in the drawing.

The rubber cylinders 2 and 4 of the four printing units 11–14 arranged above one another engage at an engagement location and can be retracted from one another. Only the rubber cylinders 2 and 4 of the lowermost printing unit 11 are shown in their retracted position as a representation of all printing units (the retraction being the same for the upper unit 12). Here, the two rubber cylinders 2 and 4 are each retracted from one another about the axes of rotation of their associated plate cylinders 3 and 5 into the positions designated as 2' and 4' in FIG. 1, approximately vertically above their respective plate cylinders 3 and 5. The rubber cylinders 2 and 4 are each supported by a retractable support means for pivoting the rubber cylinders 2 and 4 about the axis of rotation of the respective, associated plate cylinders 3 and 5. After the retraction, a gap 23 that can be easily used by the personnel for maintenance work and adjustments is opened between the two rubber cylinders 2' and 4' and the associated plate cylinders 3 and 5, as well as their ink and wetting units 6 and 7 arranged downstream. The gap 23 is shown in FIG. 1 as a rectangle and extends from the bottom 21 of the printing tower 20 up to the second printing unit 12 arranged above the lowermost printing unit 11. The gap's width corresponds approximately to the clearance between the two plate cylinders 3 and 5. All the positions and spaces now available for maintenance work and adjustments are likewise shown in FIG. 1. As known from prior-art designs, the personnel still have access to the printing units from outside, e.g., on the floor 21 or on a vertically traveling maintenance platform 31 of the printing tower 20. In addition, the gap 23 formed according to the present invention is now available with otherwise the same freedom of movement.

All the cylinders and rollers of the printing units 11–14, which form the printing tower 20, form "Δ"-shaped or "N"-shaped cylinder bridges. On the one hand, the greatest possible, namely the highest possible, gap 23 is formed by this uniform alignment of the cylinders and rollers, and on the other hand, the ink and wetting agent flow to all rubber cylinders 2 and 4 always in the same direction. Basically, it would also be possible to achieve both advantages with printing units 11–14 that form "V"-shaped cylinder bridges. In this case, the ink would be conveyed with the support of gravity instead of against it, as in the exemplary embodiment.

It is apparent from FIG. 1 that it is sufficient for the formation of a gap 23 that is easy to use, if only every other one of the printing units 11–14, preferably the lowermost printing unit 11 and the second next printing unit 13, has retractable rubber cylinders 2 and 4.

Figure 2:
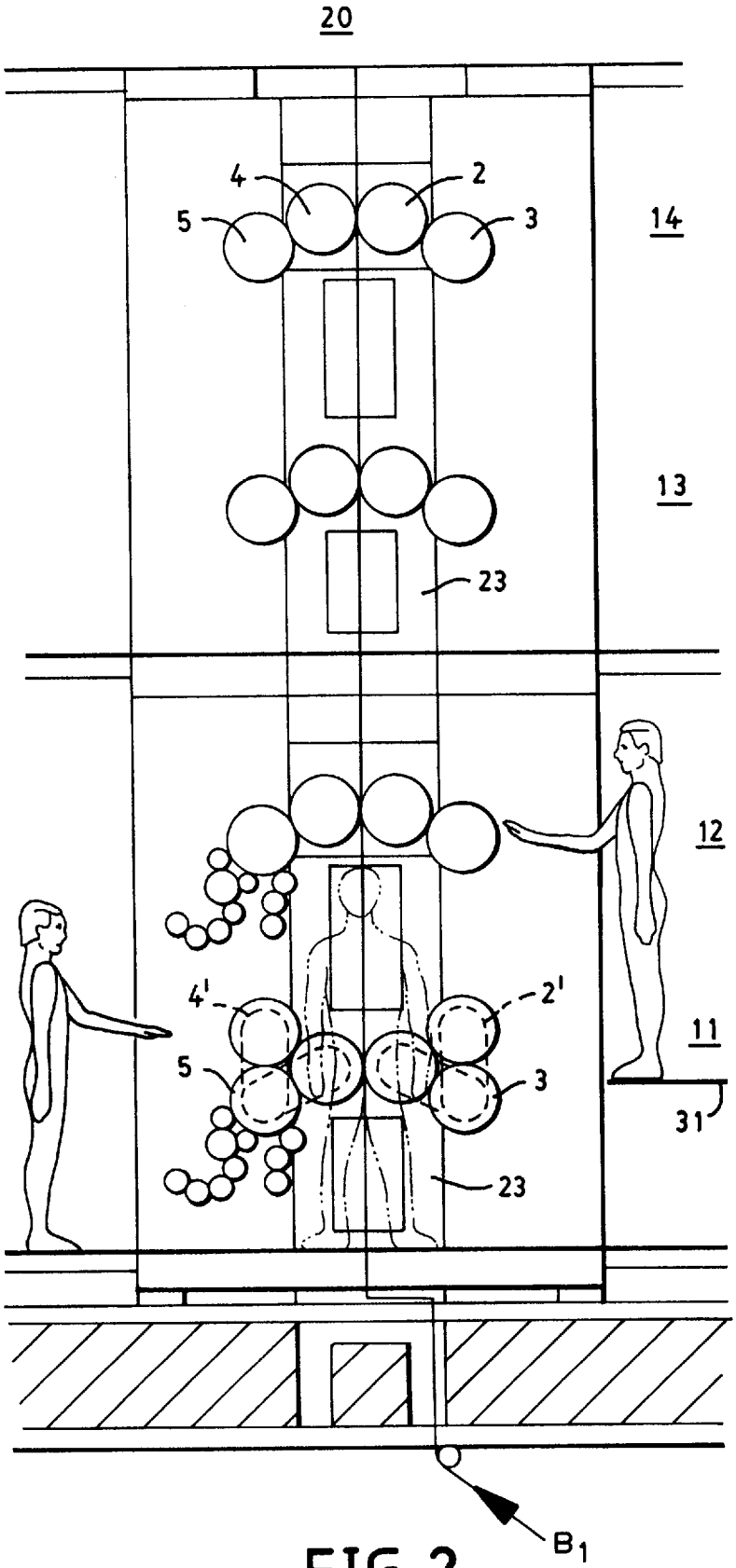
FIG. 2 is a schematic view of a printing tower according to the invention for comparison of a printing tower according to FIG. 1 and a printing tower according to the state of the art (FIG. 3), which are each designed for four-color printing.
Figure 3:
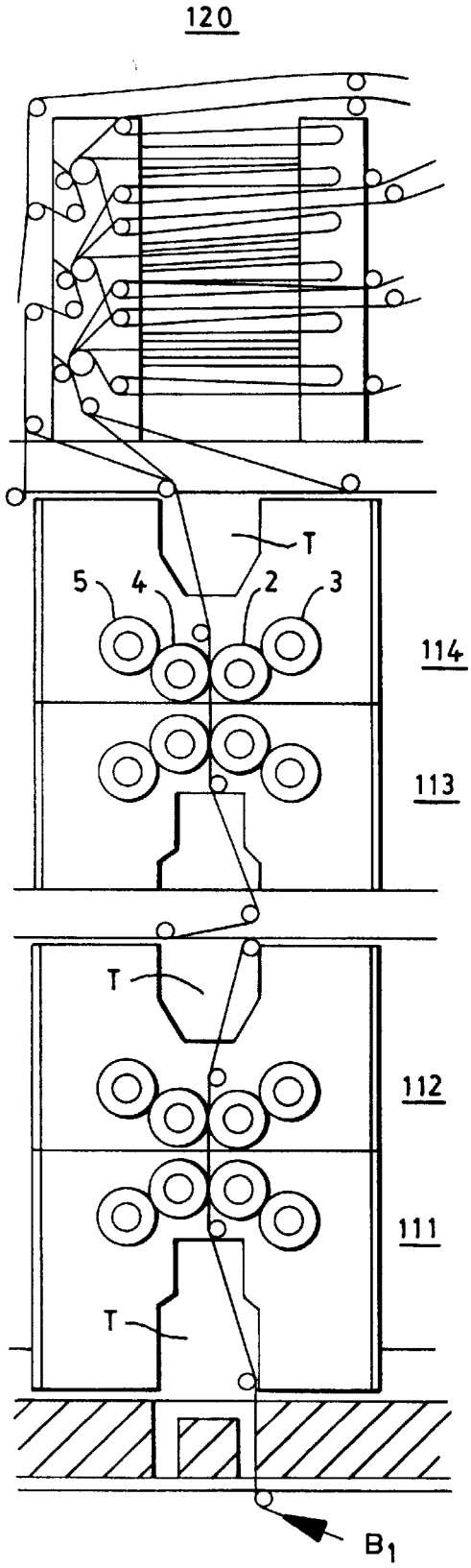
FIG. 3 is a schematic view showing the printing tower according to the state of the art for comparison with the printing tower of FIG. 2, the printing towers each being designed for four-color printing.

FIGS. 2 and 3 show the comparability as concerns a printing tower 20 with retractable rubber cylinders 2 and 4 (FIG. 2) and a printing tower 120 according to the state of the art (FIG. 3) with four printing units 111, 112, 113, 114 arranged above one another, which are arranged in H-shaped cylinder bridges. Eight single-color printing units are arranged in both printing towers 20 and 120, and two printing units each form a rubber-rubber printing unit. At the same height of the two printing towers 20 and 120, the cylinders and rollers of the printing tower 20 according to FIG. 2 are easily accessible for maintenance work and adjustments. Below and above the printing units in the prior-art H-shaped arrangement according to FIG. 3, only very low-lying maintenance tunnels T remain free. These prior-art maintenance tunnels T can be used in the prone position or at best in the bent-down position, whereby maintenance work and adjustments are made considerably difficult. With the printed web $B_1$ inserted, such work is impossible because of the printed web crossing the maintenance tunnels T.

In a corresponding arrangement of the web deflecting rollers before the feeding and after the delivery of the printed web $B_1$ into a printing unit or out of this printing unit, the entire gap 23, which is obtained by retracting the rubber cylinders 2 and 4, can be kept almost completely clear. The printed web $B_1$ inserted is moved close to one side of the gap 23, i.e., at a slight distance from one of the plate cylinders 3 or 5 and the retracted rubber cylinder 2 or 4. For this purpose, the web deflecting rollers in the area of the gap 23 thus formed are to be arranged at one of the sides of this gap 23, as can be seen in FIG. 4 in the example of a two times 1+1 color production per double printing unit.

Figure 4:
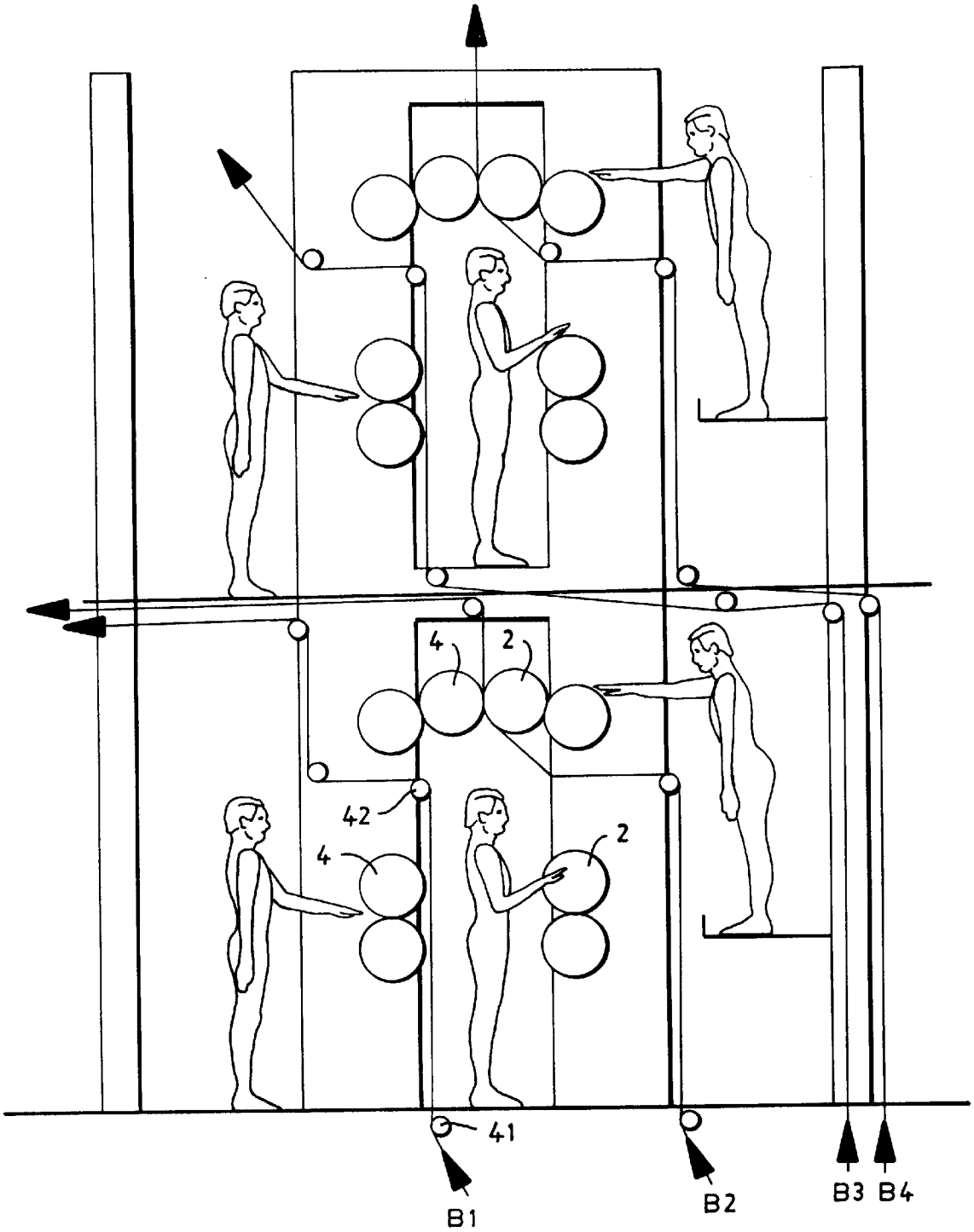
FIG. 4 is a detailed view of the printing tower according to the invention for comparison with FIG. 5, wherein both printing towers are designed for the two times 1+1 color printing.
Figure 5:
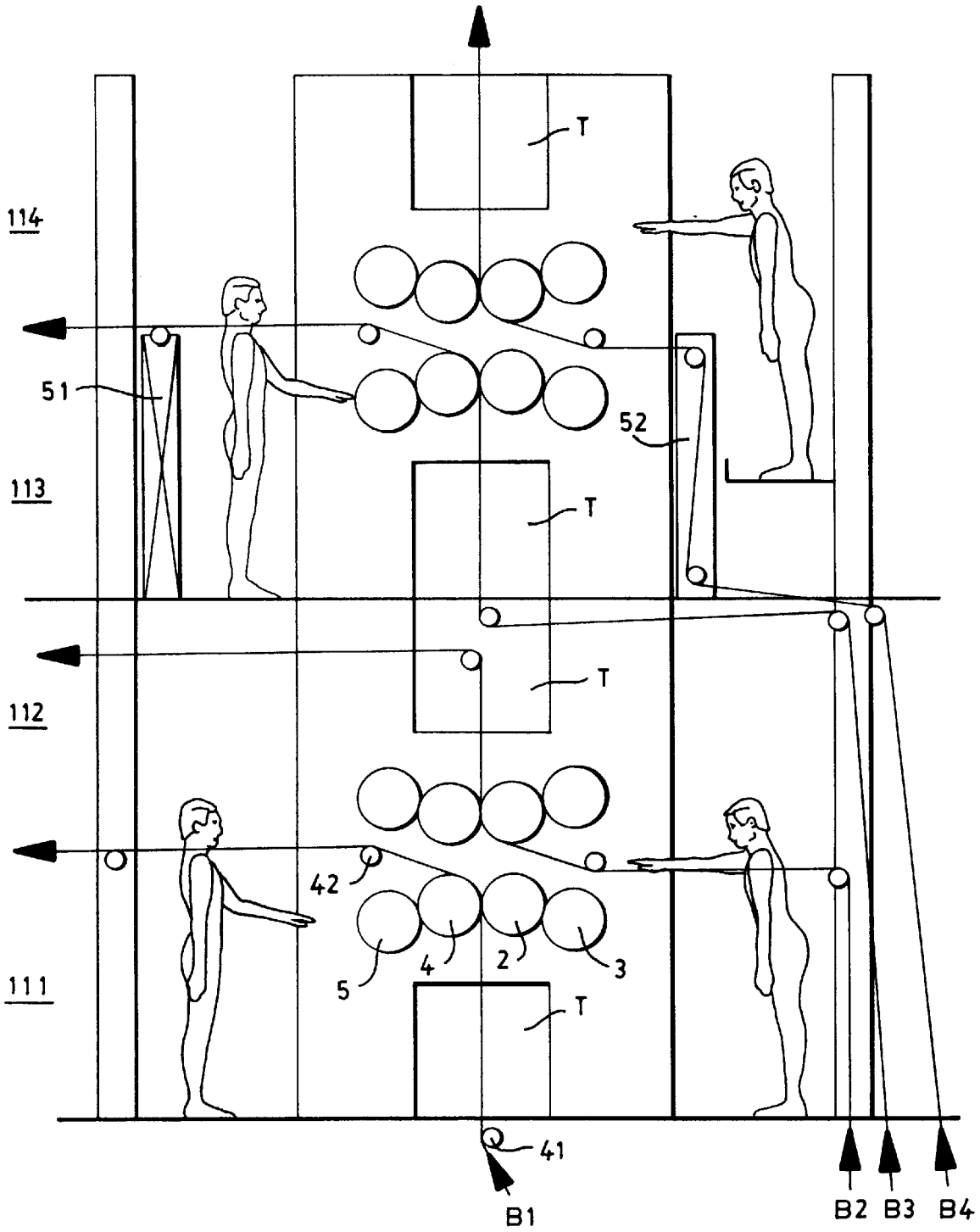
FIG. 5 is a detailed view of the printing tower according to the state of the art for comparison with FIG. 4, wherein both printing towers are designed for the two times 1+1 color printing.

In FIGS. 4 and 5, the two printing towers 20 and 120 according to FIGS. 2 and 3, respectively, are again illustrated for purposes of comparison. The printing towers 20 and 120 are each configured for a two times 1+1 color production per double printing unit 111, 112, 113, 114. In the printing units of the prior-art printing tower according to FIG. 5, which are arranged in H-shaped cylinder bridges, the accessibility of at least one of the two printing units, each forming a printing unit, is only guaranteed via the low-lying maintenance tunnels T, which are not very easy to use, with the printed webs $B_1$–$B_4$ being fed in every conceivable manner. It is thus also only possible to do work from outside in the bent-down position if the web is fed, as shown in FIG. 5, to each of the lower printing units 111 and 113 of the two H-shaped cylinder bridges. The free passage on the left and on the right of each printing unit is considerably reduced by the printed web arriving or leaving on the side. The more compact the printing units are built, the more serious is the hindrance. Furthermore, in this case each of the upper pairs of rubber cylinders of each H-shaped cylinder bridge, with the web inserted, is not accessible, e.g., for replacing plates or cleaning the rubber blanket. However, in order to guarantee accessibility to these cylinders with the press stopped and the web inserted, a corresponding effort is to be made by the preparation of corresponding web displacement means, as they are shown with 51 and 52, or other cylinder releasing devices.

If, as shown, e.g., in FIG. 4, four printed webs $B_1$–$B_4$ are each printed on both sides in a single color in one of the four printing units 11–14, the webs $B_1$–$B_4$ are guided such that the passages on the left and on the right of the printing units 11–14 remain clear. All the pairs of rubber cylinders 2 and 4 are also accessible with the printed web inserted, without web displacement or cylinder releasing means being necessary for this. Per pair of printing units 11 and 12, and 13 and 14, arranged above one another, the lower left and upper right printing units from outside and the lower right and upper left printing units are each easily accessible in the web feeding shown via the gap 23 formed by the retraction. In order to achieve this easy accessibility even with the printed web inserted, the printed web, with the rubber cylinders 2 and 4 retracted, is guided at a smallest possible distance from one of the retracted rubber cylinders, i.e., close to the sides of the gap 23. In the exemplary embodiment, this is achieved by means of the corresponding arrangement of the web deflecting rollers, which are arranged before the web feeding and after the web delivery in and out of the printing units, respectively, whose rubber cylinders 2 and 4 form the gap 23 between them in the retracted positions 2' and 4'. For this purpose, the two web deflecting rollers 41 and 42 are While specific embodiments of the invention have been shown and described in detail to illustrate the application of the principles of the invention, it will be understood that the invention may be embodied otherwise without departing from such principles.

What is claimed is:

1. A rotary printing press, comprising:

a plurality of rubber-rubber printing units, arranged essentially vertically above one another, each rubber-rubber printing unit having rubber cylinders;

retractable support means for supporting at least one of said rubber cylinders of at least one of said printing units for movement of said at least one of said rubber cylinders between an active position and a retracted position, said rubber cylinders of said at least one rubber-rubber printing unit defining a gap between said rubber cylinders of said at least one rubber-rubber printing unit in said retracted position, said gap having an extent which is greater than or substantially equal to a diameter of one of said rubber cylinders.

2. A rotary printing press in accordance with claim 1, wherein at least every other one of the said rubber-rubber printing units includes said retractable support means whereby said rubber cylinders can be retracted from one another.

3. A rotary printing press in accordance with claim 1, wherein said rubber-rubber printing units of said printing tower form either all "Δ"-shaped or "V"-shaped cylinder bridges.

4. A rotary printing press in accordance with claim 2, wherein said rubber-rubber printing units of said printing tower form either all "Δ"-shaped or "V"-shaped cylinder bridges.

5. A rotary printing press in accordance with claims 1, wherein each of said rubber-rubber printing units includes a web deflecting roller arranged for feeding the web between said two retractable rubber cylinders upstream of a location for the feeding in of the web and another web deflecting roller is arranged downstream of a location of the delivery of the web from said rubber cylinders, said deflecting roller and said another deflecting roller being arranged close to one side of said gap, which is formed after the retraction.

6. A rotary printing press in accordance with claim 1, wherein said retractable support means supports both of said rubber cylinders.

7. A rotary printing press, comprising:

a plurality of rubber-rubber printing units, arranged essentially vertically above one another, each rubber-rubber printing unit including rubber blanket cylinders positioned in an active position and plate cylinders adjacent to said rubber blanket cylinders, said rubber blanket cylinders engaging at an engagement location in said active position and said plate cylinders being spaced from said engagement location;

said rubber cylinders including at least one retractable rubber cylinder of at least one of said printing units, said retractable rubber cylinder moving between said active position and a retracted position, said rubber cylinder of said at least one rubber-rubber printing unit defining a gap between said rubber cylinders of said at least one rubber-rubber printing unit in said retracted position, said gap being of a size which is greater than or substantially equal to a distance from said engagement location to one of said plate cylinders.

8. A rotary printing press in accordance with claim 7, wherein at least every other one of the said rubber-rubber printing units includes said retractable support means whereby said rubber cylinders can be retracted from one another.

9. A rotary printing press in accordance with claim 7, wherein said rubber-rubber printing units of said printing tower form either all "Δ"-shaped or "V"-shaped cylinder bridges.

10. A rotary printing press in accordance with claim 8, wherein said rubber-rubber printing units of said printing tower form either all "Δ"-shaped or "V"-shaped cylinder bridges.

11. A rotary printing press in accordance with claims 7, wherein each of said rubber-rubber printing units includes a web deflecting roller arranged for feeding the web between said two retractable rubber cylinders upstream of a location for the feeding in of the web and another web deflecting roller is arranged downstream of a location of the delivery of the web from said rubber cylinders, said deflecting roller and said another deflecting roller being arranged close to one side of said gap, which is formed after the retraction.

12. A rotary printing press in accordance with claim 7, wherein at least one of said blanket cylinders, in said retracted position, is one of vertically above or vertically below an adjacent one of said plate cylinders in said retracted position.

13. A rotary printing press in accordance with claim 7, wherein each of said rubber cylinders is a retractable rubber cylinder.

14. A rotary printing press, comprising:

a plurality of rubber-rubber printing units, arranged essentially vertically above one another, each rubber-rubber printing unit having rubber blanket cylinders positioned in an active engaged position;

retractable support means for supporting at least one of said rubber blanket cylinders for movement between said active position and a retracted position, said rubber cylinders of said at least one rubber-rubber printing unit defining, in said retracted position, an intermediate space of a size which is substantially equal to the combined diameters of said rubber blanket cylinders to provide a space through which a human operator may pass.

15. A rotary printing press in accordance with claim 14, wherein at least every other one of the said rubber-rubber printing units includes said retractable support means whereby said rubber cylinders can be retracted from one another.

16. A rotary printing press in accordance with claim 14, wherein said rubber-rubber printing units of said printing tower form either all "Δ"-shaped or "V"-shaped cylinder bridges.

17. A rotary printing press in accordance with claim 15, wherein said rubber-rubber printing units of said printing tower form either all "Δ"-shaped or "V"-shaped cylinder bridges.

18. A rotary printing press in accordance with claims 14, wherein each of said rubber-rubber printing units includes a web deflecting roller arranged for feeding the web between said two retractable rubber cylinders upstream of a location for the feeding in of the web and another web deflecting roller is arranged downstream of a location of the delivery of the web from said rubber cylinders, said deflecting roller and said another deflecting roller being arranged close to one side of said intermediate space, which is formed after the retraction.

* * * * *